United States Patent [19]

Iwama

[11] Patent Number: 4,757,621

[45] Date of Patent: Jul. 19, 1988

[54] SKI BOOT

[75] Inventor: Shinichi Iwama, Sayama, Japan

[73] Assignee: Daiwa Seiko, Inc., Tokyo, Japan

[21] Appl. No.: 17,859

[22] Filed: Feb. 24, 1987

[30] Foreign Application Priority Data

Oct. 22, 1986 [JP] Japan ..... 61-161930[U]
Oct. 22, 1986 [JP] Japan ..... 61-161931[U]

[51] Int. Cl.[4] ..... A43B 5/04
[52] U.S. Cl. ..... 36/119; 36/120
[58] Field of Search ..... 36/117–121, 36/50

[56] References Cited

U.S. PATENT DOCUMENTS

| | | | |
|---|---|---|---|
| 4,160,332 | 7/1979 | Salomon | 36/119 |
| 4,539,763 | 9/1985 | Walkhoff | 36/120 |
| 4,644,671 | 2/1987 | Walkhoff | 36/119 |
| 4,677,768 | 7/1987 | Benoit et al. | 36/117 |

FOREIGN PATENT DOCUMENTS

| | | | |
|---|---|---|---|
| 0053340 | 6/1982 | European Pat. Off. | 36/120 |
| 2907163 | 8/1980 | Fed. Rep. of Germany | 36/120 |

*Primary Examiner*—James Kee Chi
*Attorney, Agent, or Firm*—Kalish & Gilster

[57] ABSTRACT

A ski boot comprises a foot-encasing shell body having front and rear cuffs, each being pivotally engaged on opposite sides to the shell body for relative movement away from each other into boot-open position and toward each other into boot-closed position; there being an inner boot member. A boot tightening element is carried on the rear cuff with a pair of elongated cables extending forwardly along opposite sides of the boot from said element. Each cable in the forward portion thereof being operatively related to a pressing pad overlying the inner boot member in the portion thereof disposed upon the wearer's foot between the ankle and instep. A guide is carried on each side of the shell body for training thereabout of an intermediate portion of the related cable. Each guide is so located that when the boot is in closed position the cable will substantially coincide with a line interconnecting the guide and the proximate pivot pin of the rear cuff and when said boot is in open position the cable will be removed from such interconnecting line.

7 Claims, 3 Drawing Sheets

SKI BOOT

BACKGROUND AND SUMMARY OF THE INVENTION

The present invention relates to a ski boot having an outer shell and an inner boot member which is fitted inside the outer shell. More particularly, the present invention relates to a ski boot having a foot tightening mechanism designed to tighten and untighten the front portion of the ankle of the skier's foot from the outer surface of the inner boot member in response to the opening and closing movements of the rear cuff of the outer shell.

There has heretofore been known one type of ski boot which comprises an outer shell and an inner boot member and has a tightening mechanism designed to secure the skier's foot. One example of this type of ski boot is disclosed in the specification of U.S. Pat. No. 4,160,332 (Japanese patent Laid-Open No. 118360/1977).

The above-described known ski boot is arranged as described below. A pressing member is disposed at the front portion of the ankle of an inner boot member which is fitted in an outer shell in such a manner that the pressing member is distributed over a desired region. One end of a cable is connected to this pressing member, while the other end portion of the cable is guided toward the heel portion of the outer shell and connected to a tight-fastening means attached to a rear cuff of the outer shell. When the rear cuff is tightly secured to a front cuff of the outer shell by the action of the tight-fastening means, the pressing member is caused to tighten the ankle portion in response to the operation of the tight-fastening means, thereby allowing the ski boot to be reliably secured to the skier's foot.

Accordingly, when the skier inserts his foot into the inner boot member and tightens the rear cuff with the tight-fastening means provided on the rear cuff, the pressing member tightens the front portion of the ankle through the inner boot member. Thus, it is unnecessary to conduct any special manual operation in order to fasten the ski boot, which means that the operation is conveniently simple. On the other hand, when the skier's leg is inclined forward during, for example, sliding, both the front and rear cuffs of the outer shell are also inclined forward, thus causing pulling force to be generated in the cable, which results in the pressing member tightening the ankle portion of the foot stronger than is necessary. This causes the skier's foot to suffer a pain, so that it is impossible to enjoy sliding for a long period of time, disadvantageously.

In order to overcome the above-described problem it is conventional practice to adopt an arrangement such as that disclosed in the specifications of U.S. Pat. No. 4,539,763 (Japanese patent Laid-Open Nos. 137001/1984 and 225502/1985). More specifically, a pivot shaft for the rear cuff is provided with a through-hole which curvedly extends therethrough in the diameterial direction, and a cable which is connected to a pressing pad disposed on the ankle portion is passed through the through-hole, thereby preventing any pulling force from being generated in the cable even when the rear cuff of the outer shell is pivoted forward about the pivot shaft as the skier's leg is inclined forward during, for example, sliding, and also preventing any increase in the pressure applied to the ankle from the pressing pad.

In the above-described conventional ski boot having a foot-tightening mechanism, the cable for tightening the pressing pad is guided while being passed through the diametrical through-hole formed in the pivot shaft of the rear cuff. Accordingly, even when the rear cuff is pivoted rearward about the pivot shaft so as to be opened, there is no change in the pulling force applied to the cable by means of a tight-fastening lever, and the pressing pad is therefore maintained in a state wherein it is pressed against the front portion of the ankle, which means that the skier's foot cannot smoothly be inserted into and removed from the inner boot member and an unfavorable force may act on the foot to cause it to suffer a pain. In addition, the skier's foot cannot satisfactorily be fitted to the inner boot member. Accordingly, when the foot is removed from or inserted into the inner boot member of the ski boot, it is necessary to pivot the rear cuff rearward after pivoting the tight-fastening level in the direction in which the rear cuff is opened to negate the pressure applied by the pressing pad. This involves relatively complicated and troublesome operation and the problem that the skier may forget to set the tight-fastening lever in the tightening position.

It is a first object of the present invention to provide a ski boot so designed that it is possible to release the cable from the tightening force simply by tilting the rear cuff rearward without the need to operate the foot tight-fastening means, thus facilitating the operation of putting on and off the ski boot.

It is a second object of the present invention to provide a ski boot so designed that, even when the rear cuff is inclined forward as the skier's leg is inclined forward during, for example, sliding, no pulling force acts on the cable, which force would otherwise cause the cable to tighten the foot undesirably, thus allowing the skier to enjoy skiing for a long period of time without causing his foot to suffer pain.

DESCRIPTION OF PRACTICAL EMBODIMENTS

A first embodiment of the present invention will be described hereinunder with references to FIGS. 1 and 2.

Figure 1:
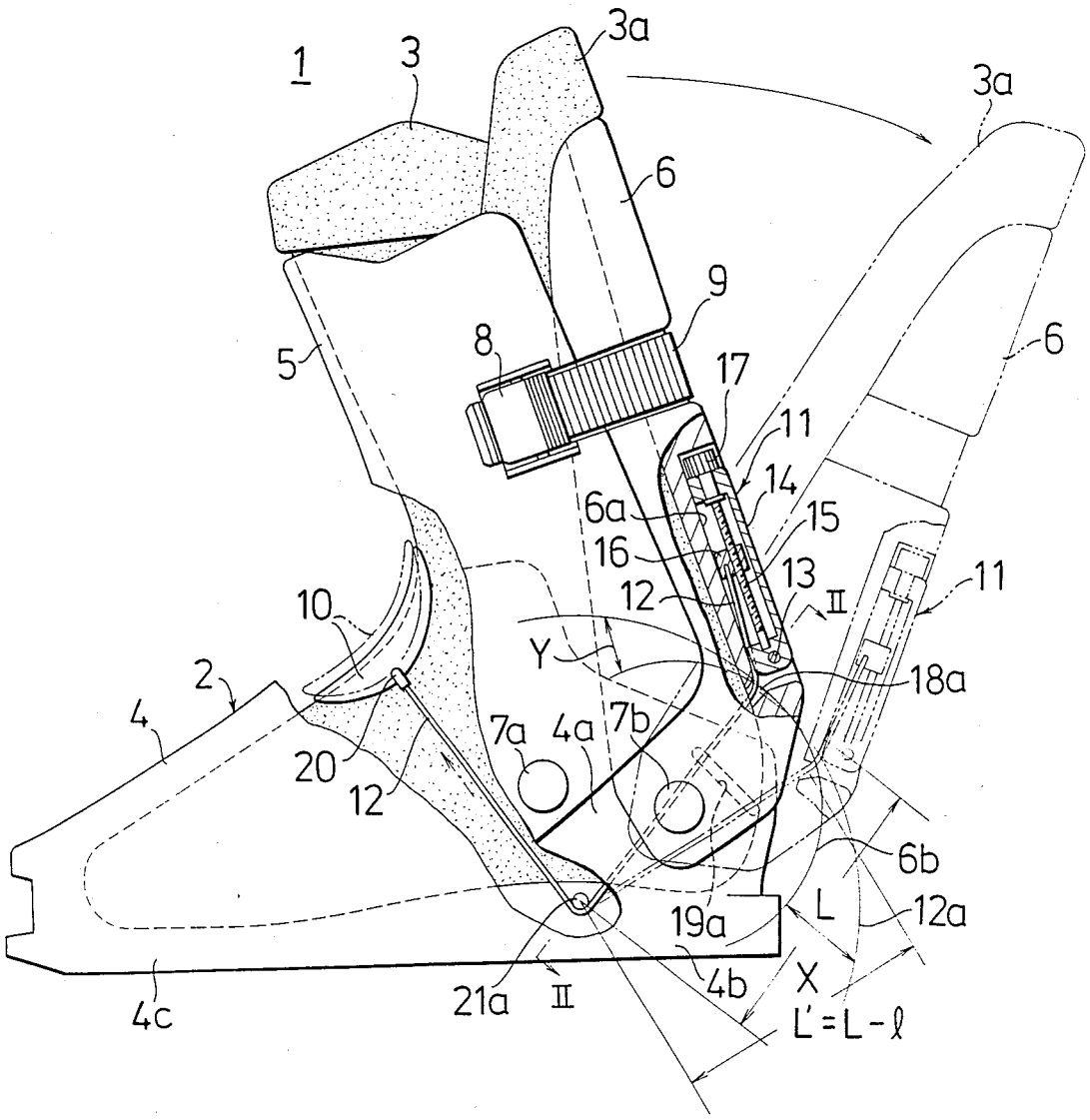
FIG. 1 is a partially-cutaway side view of a ski boot constructed in accordance with (and embodying) the present invention.
Figure 2:
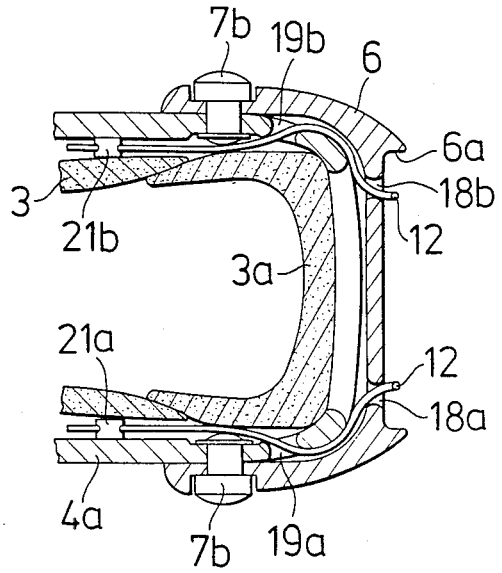
FIG. 2 is a transverse horizontal sectional view taken along the line II—II, in FIG. 1.

Referring to FIG. 1, which is a partially-cutaway general side view of a ski boot according to the present invention, a ski boot which is generally denoted by the reference numeral 1 broadly comprises an outer shell 2 formed of a rigid and tough synthetic resin material and an inner boot member 3 which is fitted in the outer shell 2.

The outer shell 2 consists of a shell body 4 which mainly covers the ankle and portions below it, a front cuff 5 which covers a part of the leg which extends from the front portion of the ankle to the lower portion of the calf, and a rear cuff 6 which covers a part of the leg which extends from the upper portion of the heel to the lower portion of the calf. The lower ends of the front and rear cuffs 5 and 6 are attached to the inner and outer heel portions of the shell body 4 by means of pins 7a and 7b so that the cuffs 5 and 6 respectively are able to pivot back and forth. The rear portion 3a of the inner boot member 3 which is superposed on the rear cuff 6 is able to opened and closed together with the rear cuff 6 in one unit. A buckle 8 for tightening is rigidly secured to one side surface of the upper portion of the front cuff 5. One end of a tightening band 9 which is engaged with the buckle 8 is rigidly secured to the reverse side surface of the front cuff 5 with respect to the buckle 8. The free end portion of the band 9 is wound on the outer periphery of the rear cuff 6 and the free end is connected to the buckle 8, thereby tightening the front and rear cuffs 5 and 6 in one unit.

In FIG. 1, the reference numeral 10 denotes a pressing pad for relatively pressing the skier's foot against the shell body 4, the pressing pad 10 being disposed on the outer surface of a portion of the inner boot member 3 which is located at the boundary between the instep and ankle portions of the foot. Cables 12 which are connected to a foot tightening means 11 are connected to the right and left edges, respectively, of the pressing pad 10.

The foot tightening means 11 is installed so that it can be accommodated within a recess 6a which is formed in the rear surface of the lower portion of the rear cuff 6. The foot tightening means 11 comprises a tight-fastening lever 14 having its lower end secured withint the recess 6a by a pin 13 so that the lever 14 is able to pivot back and forth, an adjusting screw rod 15 which longitudinally extends through the lever 14 and has both end portions rotatably supported by the lever 14, a nut member 16 which is in threaded engagement with the screw rod 15 and engaged with the lever 14 in such a manner that it cannot rotate around the axis of the screw rod 15 and which is slidable in the longitudinal direction of the lever 14 in accordance with the lead of the screw rod 15, and an adjusting knob 17 which is rigidly secured to the upper end of the screw rod 15. The cables 12 are connected to the nut member 16.

There are a pair of cables 12 which are connected to the nut member 16. These cables 12 have the same length, and the other ends of the cables 12 are led to the inside of the rear cuff 6 through respective through-holes 18a and 18b (see FIG. 2) which are formed in two corners, respectively, at the lower end of the recess 6a in the rear cuff 6, and further extended to the inside of the shell body 4 through respective slots 19a and 19b (see FIGS. 1 and 2) which are formed in a heel cover portion 4a of the shell body 4 in the vicinity of two pivot pins 7a and 7b for the rear cuff 6. The cables 12 are further passed through the area between the shell body 4 and the inner boot member 3 and connnected to the right and left edges, respectively, of the pressing pad 10 through connecting members 20. Further, cable guide portions 21a and 21b project from the opposing inner walls, respectively, of a heel bottom portion 4b of the shell body 4 at a position which is below the intermediate between the pivot pins 7a and 7b provided on the right and left sides of the front and rear cuffs 5 and 6, respectively, said position being preferably offset toward the pins 7b. The right and left cables 12 are engaged with the cable guide portions 21a and 21b, respectively, thus causing the pressing pad 10 to press the skier's foot against the heel portion of the shell body 4, and also enabling the cables 12 to be loosened simply by tilting the rear cuff 6 to an open position.

To fit the ski boot arranged as detailed above to the skier's foot, the tightening band 9 is released from the buckle 8, and the rear cuff 6 and the rear portion 3a of the inner boot member 3 are tilted to the position shown by the two-dot chain line in FIG. 1. At this time, the foot tightening means 11 is accommodated within the recess 6a in the rear cuff 6, and the means 11 per se is set in a state wherein it is applying tightening force to the pressing pad 10. However, when the rear cuff 6 is tilted about the pivot pins 7b to the position shown by the two-dot chain line in FIG. 1, the cables 12 extending between the cable guide portions 21a, 21b and the through-holes 18a, 18b move to the lower extremity along the slots 19a and 19b, and the length L' between the cable guide portions 21a, 21b and the through-holes 18a, 18b at the time the rear cuff 6 is tilted to the two-dot chain line position is l shorter than the length L when the rear cuff 6 is in the position shown by the solid line in FIG. 1. Accordingly, the cables 12 are loosened by an amount corresponding to l, and the pressing pad 10 is thus brought into the position shown by the two-dot chain line in FIG. 1. In addition, at this time the through-holes 18a and 18b in the rear cuff 6 move along the orbit 6b shown in FIG. 1 about the pins 7b as the axis of rotation, and the cables 12 move along the orbit 12a shown in FIG. 1 about the cable guide portions 21a and 21b as the axis of rotation. Within the region X where the two orbits 6b and 12a separate from each other, the length of the cables 12 are elongated, and the cables 12 are loosened. More specifically, the pressure applied to the front portion of the ankle of the inner boot member 3 is negated and it is therefore unnecessary to tilt the tight-fastening lever 14 in the direction in which the tightening force is canceled.

Under these circumstances, the skier's foot is inserted into the inner boot member 3 from the upper side of the rear cuff 6 which is opened. Thus, the skier can insert his foot into the inner boot member 3 smoothly without being restrained by the pressing pad 10 and hence without feeling any pain in the foot.

After the skier's foot has completely been inserted into the inner boot member 3, the rear cuff 6 is closed and the band 9 is passed through the buckle 8 to tighten it. In consequence, the front and rear cuffs 5 and 6 of the outer shell 2 are secured to the lower leg portion of the skier, and pulling force is generated in the cables 12, causing the pressing pad 10 to press the front portion of the ankle from the upper side of the inner boot member 3, and thus allowing the whole of the foot to be reliably secured to the shell body 4.

When the skier's foot is inclined forward during, for example, sliding, both the front and rear cuffs 5 and 6 are also inclined forward about the pivot pins 7a and 7b, respectively. However, since the cable guide portions 21a and 21b are positioned closer to the toe portions 4c of the shell body 4 than the pivot pins 7b of the rear cuff 6 as shown in FIG. 1, no pulling force is generated in the cables 12 by the forward inclination during such skiing the rear cuff 6. In regard to the relationship between the orbit 6b of the through-holes 18a and 18b in the rear cuff 6 and the orbit 12a of the cables 12, in the region Y where the orbits 6b and 12a separate from each other, the length of the cables 12 are elongated and the cables 12 are thus loosened. Accordingly, there is no fear of a pressure higher than a set value being applied to the front portion of the ankle, so that the skier can enjoy skiing for a long period of time without causing his foot to suffer a pain.

It is possible to take off the ski boot simply by removing the band 9 from the buckle 8 and then tilting the rear cuff 6 to the position shown by the two-dot chain line in FIG. 1, and there is not need to operate the tight-fastening lever 14. Accordingly, the operation of putting on and off the ski boot is facilitated, and it is possible to eliminate the conventional problem that the skier may forget to tighten the lever 14.

The tightening force applied to the front portion of the ankle by the pressing pad 10 can be adjusted simply by rotating the screw rod 15 with the knob 17 to move the position of the nut member 16 vertically.

It should be noted that, although in the above-described embodiment the cables 12 are employed as foot-tightening continuous members, band-like members may also be employed. Further, in place of the pressing pad 10, the cables 12 may be employed to press the front portion of the ankle in the inner boot member 3. It is also possible to put on and off the ski boot in a state wherein the lever 14 is tilted rearward.

Figure 3:
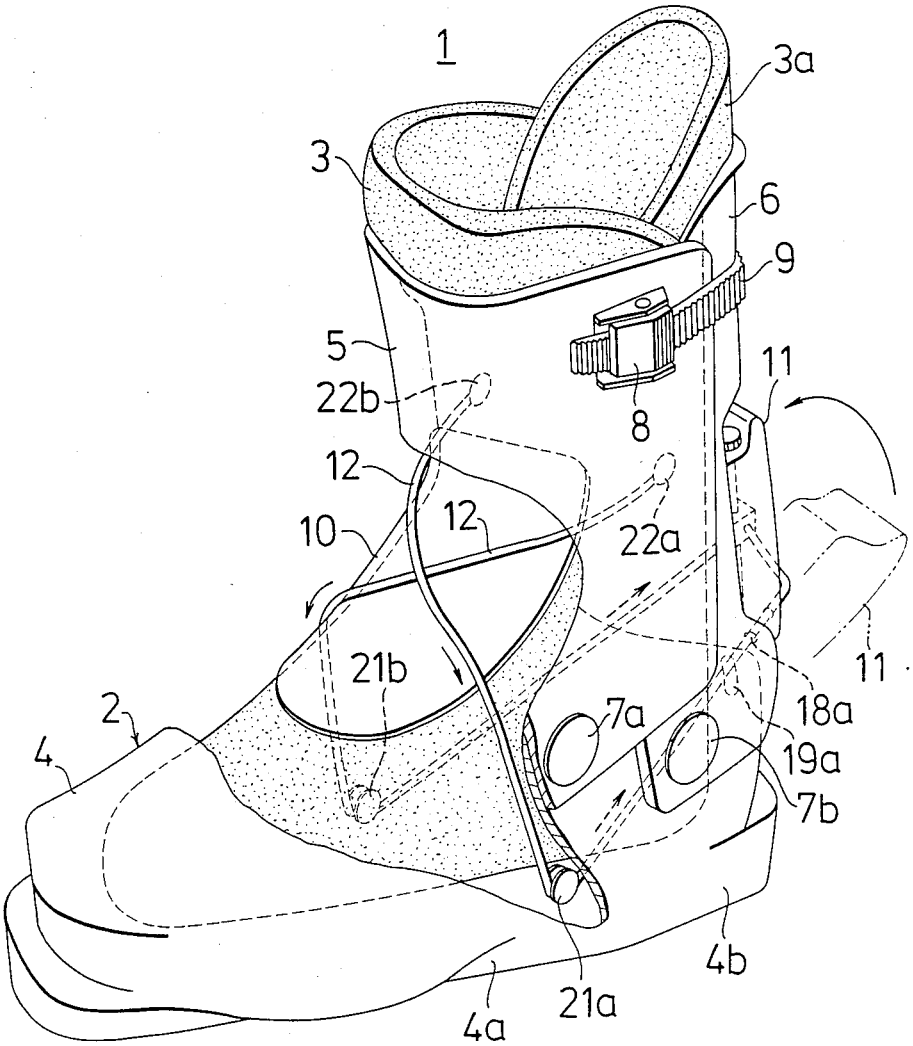
FIG. 3 is a partially-cutaway perspective view of another form of a ski boot constructed in accordance with (and embodying) the present invention.

Referring next to FIG. 3, there is shown a modification of the cables 12 employed in the first embodiment. Since constitutent elements other than the cables 12 are the same as those in the first embodiment, the essential part alone will be explained below.

First ends 22*a* and 22*b* of a pair of cables 12 are rigidly secured to the left and right inner surfaces, respectively, of the approximately central portion of the front cuff 5 as viewed in the vertical direction. Second end portions of the cables 12 are crossed each other on the instep portion of the inner boot member 3 where the pressing pad 10 is disposed. The cables 12 are then guided toward the bottom 4*a* of the shell body 4 along the outer surface of the inner boot member 3, and engaged with cable guide portions 21*a* and 21*b* which are provided on both sides, respectively, of a portion of the bottom 4*a* of the shell body 4 on the side thereof which is closer to the heel. The cables 12 engaged with the guide portions 21*a* and 21*b* are turned toward a heel cover portion 4*b* of the shell body 4, passed through slots 9*a* and 19*b*, respectively, formed in the heel cover portion 4*b*, and then led out of the rear cuff 6 through through-holes 18*a* and 18*b*, respectively, formed in the rear cuff 6. The cables 12 thus led out of the rear cuff 6 are connected to a tight-fastening means 11 which is attached to the rear portion of the rear cuff 6.

What is claimed is:

1. In a ski boot having a foot-encasing, outer shell body with inner and outer walls and a heel portion, said shell body further having a front cuff for covering the front portion of the ankle and adjacent lower leg portion of the wearer, first pivot means engaging said front cuff to the heel portion of said outer shell body for movement into forwardly or boot-open position and rearward or boot-closed position, a rear cuff, second pivot means engaging said rear cuff to said heel portion of said outer shell body rearwardly of said first pivot means whereby said rear cuff may be swung between forwardly, boot-closed and rearwardly, boot-open position, an inner boot member disposed within said outer shell body having front and rear portions confronting the proximate portions of the front and rear cuffs for movement therewith, the improvement comprising a boot tightening element provided on said rear cuff, a pair of elongated, flexible members each having one end engaged to opposite portions of said tightening element, each of said elongated, flexible members progressing forwardly on opposite sides of said boot from said tightening element with the outer or forward end being anchored in the forward portion of said boot, opposed guides mounted on the inner walls of the heel portion of said outer shell body engaging intermediate portions of said elongated, flexible member, and said guides being located below, and forwardly of, said second pivot means for causing loosening of said elongatged, flexible members with decreased pressure of said tightening element upon said front cuff and rear cuff when in boot-closed position pivoting forwardingly during skiing, said second pivot means comprising first and second pivot pins engaging the opposed lower forward portions of said rear cuff to said outer shell body, said first and second pivot pins and the proximate guides being so relatively disposed that when said rear cuff is in forwardly boot-closed position the adjacent portions of said elongagted, flexible member were presented substantially coincident with a line intersecting the guide and the proximate first or second pivot pin, and when said rear cuff is in boot-open position the adjacent portions of said elongatged, flexible member will be located beyond the aforesaid line of intersection for causing loosening of the elongated flexible members when the rear cuff is in boot-open position, there being a pressing pad disposed on the outer forward surface of the inner boot member overlying the zone between the ankle and instep of the wearer, and the forward ends of said elongated, flexible members are fixed to opposite side portions of said pressing pad.

2. The invention defined in claim 1 wherein the forward ends of each elongated, flexible member are led upwardly from the respective guide across the forward surface of the inner boot member overlying the zone between the ankle and instep portions of the wearer in mutual crossing relationship, the forward end extremities of the members being anchored to said front cuff.

3. The invention defined in claim 2 wherein crossing portions of said elongated, flexible members extend across said pressing pad, the points of anchorage of said elongated, flexible member and extremities being upwardly and rearwardly of said pressing pad.

4. A ski boot as defined in claim 1 wherein said elongated, flexible members are cables.

5. A ski boot according to claim 1 wherein said elongated, flexible members are of band-like character.

6. A ski boot as defined in claim 1 wherein said boot tightening element comprises a lever member, means pivotly engaging said lever member in the lower portion thereof upon said rear cuff for swingable movement between upper or forward position and downward or rearward position.

7. A ski boot according to claim 1 wherein a fastening element is secured to one side surface of the upper portion of the front cuff, a band having opposed ends, one end of said band being secured to the opposed side surface of the upper portion of the front cuff carrying said fastening element, and the other, free end of the band being detachably engageable to said fastening element.

* * * * *

UNITED STATES PATENT AND TRADEMARK OFFICE

CERTIFICATE OF CORRECTION

PATENT NO. : 4,757,621

DATED : July 19, 1988

INVENTOR(S) : Shinichi Iwama

It is certified that error appears in the above-identified patent and that said Letters Patent is hereby corrected as shown below:

Column 6, line 6 - "outer" should be --other--.

Column 6, line 12 - "elongatged" should be --elongated--.

Column 6, line 22 - "elongagted" should be --elongated--.

Column 6, line 26 - "elongatged" should be --elongated--.

Signed and Sealed this

Twenty-ninth Day of November, 1988

*Attest:*

DONALD J. QUIGG

*Attesting Officer*

*Commissioner of Patents and Trademarks*